US007391395B2

(12) United States Patent
Kim

(10) Patent No.: US 7,391,395 B2
(45) Date of Patent: Jun. 24, 2008

(54) SUPER TWISTED NEMATIC (STN) LIQUID CRYSTAL DISPLAY (LCD) DRIVER AND DRIVING METHOD THEREOF

(75) Inventor: Hyoung-rae Kim, Suwon (KR)

(73) Assignee: Samsung Electronics Co., Ltd. (KR)

( * ) Notice: Subject to any disclaimer, the term of this patent is extended or adjusted under 35 U.S.C. 154(b) by 443 days.

(21) Appl. No.: 10/712,164

(22) Filed: Nov. 13, 2003

(65) Prior Publication Data

US 2004/0095307 A1 May 20, 2004

(30) Foreign Application Priority Data

Nov. 16, 2002 (KR) ..... 10-2002-0071391

(51) Int. Cl.
*G09G 3/36* (2006.01)

(52) U.S. Cl. ..... 345/87; 345/89; 345/95; 345/94; 345/100

(58) Field of Classification Search ..... 345/87, 345/89, 204, 63, 77, 100, 690, 147, 55, 95, 345/94, 148, 99, 58, 96, 102, 211, 212, 208, 345/210, 60, 68, 149, 190
See application file for complete search history.

(56) References Cited

U.S. PATENT DOCUMENTS 5,495,287 A * 2/1996 Kasai et al. ..... 345/89
5,638,091 A * 6/1997 Sarrasin ..... 345/692
5,657,043 A * 8/1997 Fukui et al. ..... 345/100
5,818,419 A * 10/1998 Tajima et al. ..... 345/691
5,861,869 A * 1/1999 Scheffer et al. ..... 345/691
5,900,856 A * 5/1999 Iino et al. ..... 345/100
5,953,002 A * 9/1999 Hirai et al. ..... 345/204
5,969,699 A * 10/1999 Balram et al. ..... 345/10
6,072,451 A * 6/2000 Mano et al. ..... 345/89
6,084,561 A 7/2000 Kudo et al. ..... 345/89
6,094,243 A * 7/2000 Yasunishi ..... 349/33
6,144,373 A * 11/2000 Nakazawa et al. ..... 345/204

(Continued)

FOREIGN PATENT DOCUMENTS

KR 96-706154 11/1996

OTHER PUBLICATIONS

Matuszczy. Liquid Crystals in Displays [online], [last retrieved Jun. 21, 2007]. Retrieved from Internet <http://www.mc2.chalmers.se/pl/lc/engelska/applications/Displays.html>.

*Primary Examiner*—Prabodh Dharia
(74) *Attorney, Agent, or Firm*—Mills & Onello LLP

(57) ABSTRACT

A super twisted nematic (STN) liquid crystal display (LCD) driver and a driving method thereof includes a sub frame counter that counts the number of sub frames in response to a clock signal and generates a sub frame flag signal when each sub frame is counted. An N clock counter receives an N-line signal and generates an N-line flag signal when the number of N-line counted is N in response to the clock signal. A frame counter receives a frame rate control (FRC) selection signal, counts the number of the sub frame flag signal, and generates a frame flag signal when the number of the sub frame flag signal counted is n. A liquid crystal polarity inversion signal generator receives one of the sub frame flag signal, the N-line flag signal, and the frame flag signal in response to a selection signal, and generates a liquid crystal polarity inversion signal.

13 Claims, 8 Drawing Sheets

U.S. PATENT DOCUMENTS 6,175,355 B1 * 1/2001 Reddy ..... 345/691
6,191,768 B1 * 2/2001 Imamura ..... 345/98
6,249,265 B1 * 6/2001 Tajima et al. ..... 345/63
6,329,981 B1 * 12/2001 Lin et al. ..... 345/204
6,466,192 B2 * 10/2002 Imamura ..... 345/98
6,483,497 B1 * 11/2002 Iino et al. ..... 345/100
6,628,258 B1 * 9/2003 Nakamura ..... 345/98
6,873,311 B2 * 3/2005 Yoshihara et al. ..... 345/87
6,897,884 B2 * 5/2005 Tsuge et al. ..... 345/690
7,319,449 B2 * 1/2008 Yamazaki et al. ..... 345/89
7,321,354 B1 * 1/2008 Jacobsen et al. ..... 345/102
2002/0149576 A1 * 10/2002 Tanaka et al. ..... 345/204
2002/0196243 A1 * 12/2002 Morita ..... 345/204
2003/0048238 A1 * 3/2003 Tsuge et al. ..... 345/55

* cited by examiner

| LIQUID CRYSTAL POLARITY INVERSION SIGNAL M | H | | L | |
|---|---|---|---|---|
| | COM VOLTAGE (VCOM) | SEGMENT VOLTAGE (VSEG) | COM VOLTAGE (VCOM) | SEGMENT VOLTAGE (VSEG) |
| SELECTION | VSS | V0 | V0 | VSS |
| NON-SELECTION | V1 | V2 | V4 | V3 |

SUPER TWISTED NEMATIC (STN) LIQUID CRYSTAL DISPLAY (LCD) DRIVER AND DRIVING METHOD THEREOF

BACKGROUND OF THE INVENTION

This application claims priority from Korean Patent Application No. 2002-71391, filed on Nov. 16, 2002, in the Korean Intellectual Property Office, the contents of which are incorporated herein in their entirety by reference.

1. Field of the Invention

The present invention relates to a super twisted nematic (STN) liquid crystal display (LCD) driver, and more particularly, to an STN LCD driver using a frame rate control (FRC) technique as a driving method.

2. Description of the Related Art

In a super twisted nematic (STN) liquid crystal display (LCD) driver using an iAPT or APT method, pulse width modulation, frame rate control (FRC), or a combination thereof is widely used to present gray scales and colors.

FIG. 1 is a table showing levels of a super twisted nematic (STN) liquid crystal driving voltage in response to a level of a liquid crystal polarity inversion signal M in a FRC method.

The liquid crystal polarity inversion signal M is a periodic signal used to prevent liquid crystal from solidifying. That is, the level of the liquid crystal polarity inversion signal M has to be periodically inverted so as to prevent the liquid crystal from solidifying. After the level of the liquid crystal polarity inversion signal M is inverted, levels of a segment voltage VSEG driving a column electrode of an STN liquid crystal and a corn voltage VCOM driving a row electrode of the STN liquid crystal are also inverted.

Referring to FIG. 1, if the level of the liquid crystal polarity inversion signal M is high, the selection voltage level of the segment voltage VSEG is V0. If the level of the liquid crystal polarity inversion signal M is low, the non-selection voltage level of the segment voltage VSEG is Vss.

A relationship between the voltage levels of the segment voltage VSEG can be expressed by V0>V2>V3>Vss.

If the level of the liquid crystal polarity inversion signal M is high, a non-selection voltage level of the segment voltage VSEG is V2. If the level of the liquid crystal polarity inversion signal M is low, the non-selection voltage level of the segment voltage VSEG is V3.

Similarly to the voltage level of the segment voltage VSEG, the voltage level of the corn voltage VCOM is also inverted in response to the level of the liquid crystal polarity inversion signal M.

If the level of the segment voltage VSEG or the corn voltage VCOM are the selection voltage level, the liquid crystal is turned on and presented as black. If the level of the segment voltage VSEG or the corn voltage VCOM are the non-selection voltage level, the liquid crystal is turned off and presented as white.

Yet, if the non-selection voltage levels V2 and V3 of the segment voltage VSEG are not used the same number of times in the FRC method, cross talk occurs in the liquid crystal.

FIGS. 2A through 2D are waveforms of a segment voltage VSEG in a conventional STN LCD driving method using a 3FRC method.

A frame in an nFRC method is comprised of n of sub frames. Thus, a frame in the 3FRC method is comprised of three sub frames. Pixels at the right side of FIGS. 2A through 2D present different gray scales of the liquid crystal.

That is, FIG. 2A shows the liquid crystal presenting black, FIG. 2B shows the liquid crystal presenting dark gray, FIG. 2C shows the liquid crystal presenting light gray, and FIG. 2D shows the liquid crystal presenting white.

At each sub frame, the level of the liquid crystal inversion signal M is inverted. Thus, the same signal is repeated once every six sub frames.

In the first sub frame, the level of the liquid crystal polarity inversion signal M is high. In the second sub frame, the level of the liquid crystal polarity inversion signal M is inverted, i.e., low. Accordingly, in order to present the liquid crystal as dark gray, two sub frames have to present black, and one sub frame has to present white as shown in FIG. 2B.

Referring to FIG. 2B, in order to present the liquid crystal as dark gray, the level of the segment voltage VSEG is V0 which is the selection voltage level in the first sub frame where the level of the liquid crystal inversion signal M is high. The level of the segment voltage VSEG is Vss which is the non-selection level in the second sub frame where the level of the liquid crystal inversion signal M is low. The level of the segment voltage. VSEG is V2 which is the non-selection level in the third sub frame where the level of the liquid crystal inversion signal M is high. When such sub frames are consecutively repeated by a period over 60Hz, human eyes recognize these as dark gray. Here, since the selection voltage levels V0 and Vss and the non-selection voltage levels V2 and V3 are used the same number of times in total 6 sub frames, cross talk does not occur in the liquid crystal.

FIGS. 3A through 3E are waveforms of a segment voltage VSEG in a conventional STN LCD driving method using a 4FRC method.

A frame is comprised of four sub frames. Referring to FIG. 3B, only V3 is used as the non-selection voltage level, and V2 is not used as the non-selection voltage level. In addition, the selection voltage level V0 is more frequently used than the other non-selection voltage level Vss.

Referring to FIG. 3C, the selection voltage levels V0 and Vss are used the same number of times, and the non-selection voltage levels V2 and V3 are used the same number of times also.

Referring to FIG. 3D, the non-selection voltage level V3 is more frequently used than the non-selection other voltage level V2. Only V0 is used as the selection voltage level, and Vss is not used as the selection voltage level.

Thus, cross talk occurs in the liquid crystal in the waveforms of FIGS. 3B and 3D, and does not occur in the liquid crystal in the waveform of FIG. 3C.

FIGS. 4A through 4E are waveforms of a segment voltage in an STN LCD driving method using an N-line inversion method.

The N-line inversion method is used to prevent cross talk shown in FIGS. 3A through 4E from occurring. The N-line inversion method includes dividing one frame into N sub frames and inverting the level of the liquid crystal inversion signal M in each sub frame.

Referring to FIGS. 4A through 4E, the selection voltage level or the non-selection voltage level are used the same number of times. Therefore, cross talk can be prevented from occurring in the liquid crystal.

However, the N-line inversion method increases the number of transitions of the level of the segment voltage VSEG. Thus, power consumption also increases. That is, the nFRC method has a disadvantage in that cross talk occurs, and the N-line inversion method has a disadvantage of increased power consumption.

SUMMARY OF THE INVENTION

The present invention provides a super twisted nematic (STN) liquid crystal display (LCD) driver which makes it possible to use selection voltage levels and non-selection voltage levels the same number of times and reduces the number of transitions of the level of a segment voltage.

The present invention also provides a driving method of an STN LCD driver which makes it possible to use selection voltage levels and non-selection voltage levels the same number of times and reduces the number of transitions of a level of a segment voltage.

According to a first embodiment of an aspect of the present invention, there is provided a super twisted nematic (STN) liquid crystal display (LCD) driver comprising a sub frame counter, an N clock counter, a frame counter, and a liquid crystal polarity inversion signal generator. The sub frame counter counts the number of sub frames in response to a clock signal and generates a sub frame flag signal every time each sub frame is counted. The N clock counter receives an N-line signal and generates an N-line flag signal every time when the number of N-line counted is N in response to the clock signal. The frame counter receives a frame rate control (FRC) selection signal, counts the number of the sub frame flag signal, and generates a frame flag signal every time the number of the sub frame flag signal counted is n. The liquid crystal polarity inversion signal generator receives one of the sub frame flag signal, the N-line flag signal, and the frame flag signal in response to the FRC selection signal, and generates a liquid crystal polarity inversion signal that inverts a polarity of an STN LCD.

In one embodiment, the STN LCD driver further comprises a column driver and a row driver. The column driver receives data and generates a segment voltage that drives a column electrode of the STN LCD in response to a level of the liquid crystal polarity inversion signal. The row driver receives a row selection signal and generates a corn voltage that drives a row electrode of the STN LCD in response to the level of the liquid crystal polarity inversion signal.

The FRC selection signal has information on whether a driving method of the STN LCD is an nFRC method, where n is a natural number. The N-line signal can have information used to divide a frame into N sub frames, where N is a natural number.

According to another aspect of the present invention, there is provided a driving method of a super twisted nematic (STN) liquid crystal display (LCD) driver. The driving method comprises (a) counting the number of sub frames in response to a clock signal and generating a sub frame flag signal every time each frame is counted, (b) receiving an N-line signal and generating an N-line flag signal in response to input of the clock signal every time the number of N-line counted is N in response to the clock signal, (c) receiving a frame rate control (FRC) selection signal, counting the number of sub frame flag signals, and generating a frame flag signal every time the number of sub frame flag signals counted is n, and (d) selecting one of the sub frame flag signal, the N-line flag signal, and the frame flag signal in response to the FRC selection signal, and generating a liquid crystal polarity inversion signal that inverts a polarity of the STN CLD.

The driving method of the STN LCD driver further comprises (e) receiving data and generating a segment voltage that drives a column electrode of the STN LCD in response to the level of the liquid crystal polarity inversion signal and (f) receiving a row selection signal and, in response to the level of the liquid crystal polarity inversion signal, generating a corn voltage that drives a row electrode of STN LCD.

According to another aspect of the present invention, there is provided a driving method of a super twisted nematic (STN) liquid crystal display (LCD) driver. The driving method comprises (a) determining whether a frame rate control (FRC) selection signal is in accordance with an nFRC method, (b) counting the number of sub frames, and (c) generating a liquid crystal polarity inversion signal that inverts a polarity of the STN LCD if the number of sub frames is n.

The driving method of the STN LCD driver further comprises (d) receiving data and, in response to the level of the liquid crystal polarity inversion signal, generating a segment voltage that drives a column electrode of the STN LCD and (f) receiving a row selection signal and, in response to the level of the liquid crystal polarity inversion signal, generating a corn voltage that drives a row electrode of the STN LCD.

In one embodiment, N sub frames constitute one frame.

According to a third embodiment of the present invention, there is provided a driving method of a super twisted nematic (STN) liquid crystal display (LCD) driver using an nFRC method, wherein a polarity of the STN LCD is inverted in each frame. One frame is comprised of n sub frames.

BRIEF DESCRIPTION OF THE DRAWINGS

The foregoing and other objects, features and advantages of the invention will be apparent from the more particular description of a preferred embodiment of the invention, as illustrated in the accompanying drawings in which like reference characters refer to the same parts throughout the different views. The drawings are not necessarily to scale, emphasis instead being placed upon illustrating the principles of the invention.

FIGS. 2A through 2D are waveforms of a segment voltage VSEG used in a conventional STN LCD driving method using a 3FRC method.

DETAILED DESCRIPTION OF THE INVENTION

Figure 5:
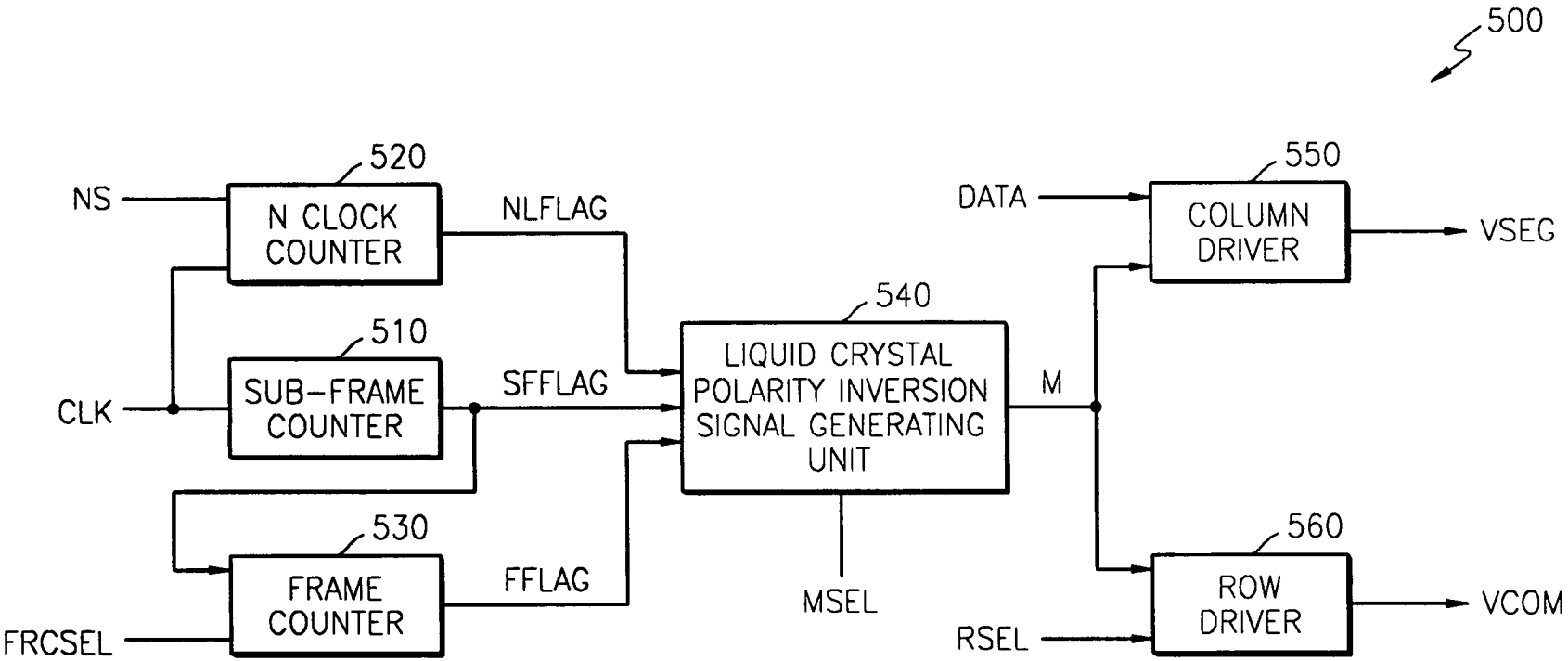
FIG. 5 is a block diagram of an STN LCD driver according to an embodiment of the present invention.

FIG. 5 is a block diagram of the STN LCD driver 500 according to an embodiment of the present invention.

Referring to FIG. 5, the STN LCD driver 500 includes a sub frame counter 510, an N clock counter 520, a frame counter 530, and a liquid crystal polarity inversion signal generator 540.

The sub frame counter 510 counts the number of sub frames in response to a clock signal CLK and generates a sub frame flag signal SFFLAG every time when each sub frame is counted.

The N clock counter 520 receives an N-line signal NS and generates an N-line flag signal NLFLAG every time when the number of lines counted is N in response to the clock signal CLK. The N-line signal NS has information used to divide a frame into N sub frames. Here, "N" is a natural number.

The frame counter 530 receives a frame rate control (FRC) selection signal FRCSEL, counts the number of sub frame flag signals SFFLAG, and generates a frame flag signal FFLAG every time when the number of sub frame flag signal SFFLAG counted is n. The FRC selection signal FRCSEL has information on whether a driving method of the STN LCD is an nFRC method. Here, "n" is a natural number.

The liquid crystal polarity inversion signal generator 540 receives one of the sub frame flag signal SFFLAG, the N-line flag signal NLFLAG, and the frame flag signal FFLAG in response to a selection signal MSEL and generates a liquid crystal polarity inversion signal M which inverts a polarity of the liquid crystal.

The STN LCD driver 500 may further include a column driver 550 and a row driver 560. The column driver 550 receives data DATA and generates a segment voltage VSEG that drives a column electrode of the STN LCD in response to the liquid crystal polarity inversion signal M.

The row driver 560 receives a row selection signal RSEL and generates a corn voltage VCOM that drives a row electrode of the STN LCD in response to the liquid crystal polarity inversion signal M.

Figure 8:
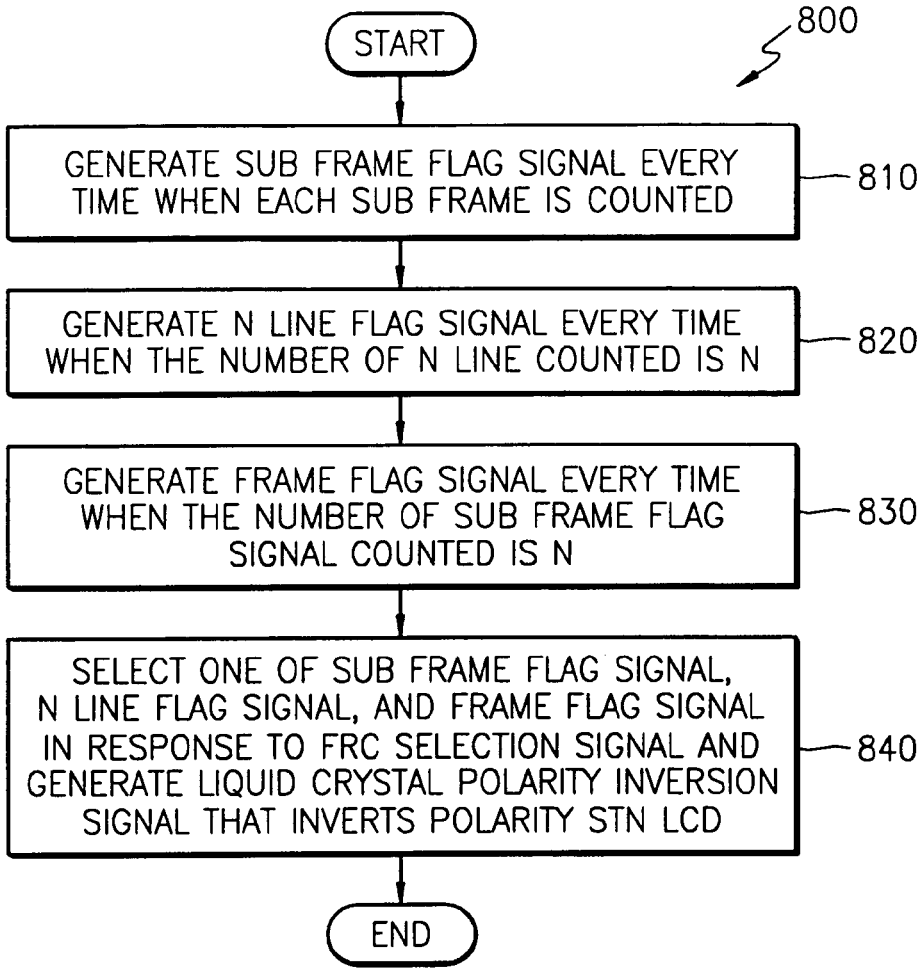
FIG. 8 is a block diagram showing a driving method of an STN LCD driver according to an embodiment of the present invention.
Figure 9:
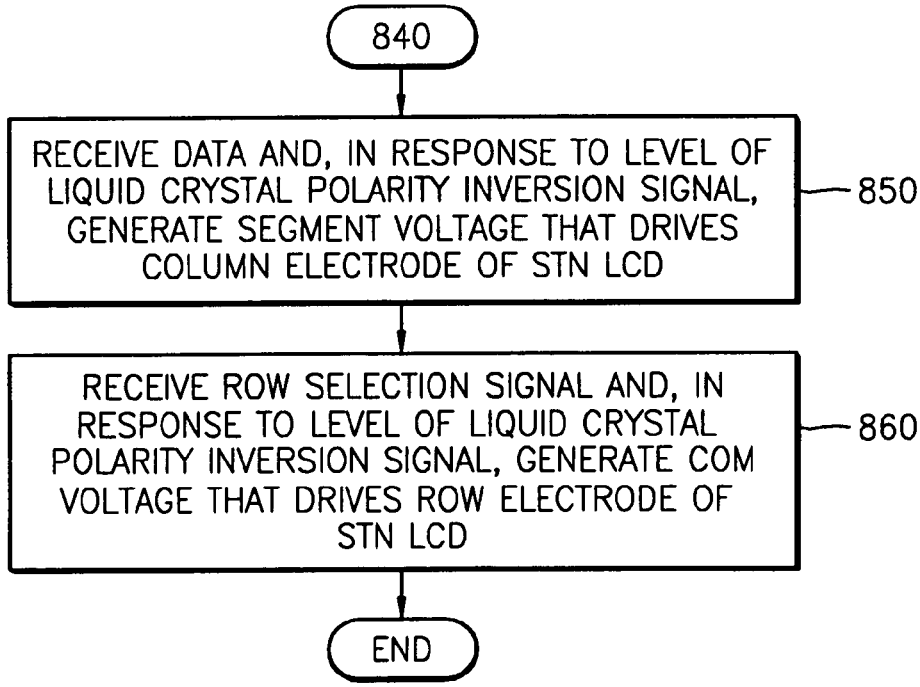
FIG. 9 is a block diagram showing a driving method of an STN LCD driver further included in the method of FIG. 8.

The operation of the STN LCD driver 500 of FIG. 5 will be described with reference to a driving method of an STN LCD driver 800 of FIGS. 8 and 9.

In the conventional art, the level of the liquid crystal polarity inversion signal M is inverted at each sub frame to control the levels of the segment voltage VSEG and the corn voltage VCOM so that the liquid crystal can be prevented from solidifying. In the present invention, the level of the liquid crystal polarity inversion signal M is inverted in each frame to control the levels of the segment voltage VSEG and the corn voltage VCOM.

In response to the clock signal, the number of sub frames is counted, and a sub frame flag signal is generated every time when each sub frame is counted (step 810). The sub frame counter 510 counts the number of sub frames in response to the clock signal CLK.

If a driving method of the STN LCD driver is the nFRC method, a frame is comprised of n sub frames. The sub frame counter 510 generates the sub frame flag signal SFFLAG every time when each sub frame is counted. Therefore, in the nFRC method, the total number of the sub frame flag signal SFFLAG generated is n.

The N-line signal is received, and the N-line flag signal is generated every time when the number of N-line counted is N in response to the clock signal CLK (step 820). The N clock counter 520 receives the N-line signal NS and counts the N number of the N-line. The N-line signal NS has information used to divide a frame into the N sub frames. Here, "N" is a natural number. The N clock counter 520 generates the N-line flag signal NLFLAG every time when the number of N-lines counted is N.

A FRC selection signal is received, and the number of sub frame flag signal is counted to generate a frame flag signal every time when the number of frame flag signal FFLAG counted is n (step 830). The frame counter receives the FRC selection signal FRCSEL and counts the number of sub fame flag signal SFFLAG.

The FRC selection signal FRCSEL has information on whether a driving method of the STN LCD is an nFRC method. Here, "n" is a natural number. If the driving method of the STN LCD is a 3FRC method, "n" is 3, thus a frame is comprised of three sub frames. Since the sub frame flag signal SFFLAG is generated every time when each sub frame is counted, the number of sub frame flag signal SFFLAG generated is 3.

If 3 sub frame flag signals SFFLAGs are generated, the frame counter 530 generates one frame flag signal FFLAG. That is, the frame counter 530 generates a frame flag signal FFLAG in each frame.

In response to the FRC selection signal FRCSEL, one of the sub frame flag signal, the N-line flag signal, and the frame flag signal FFLAG is selected, and the liquid crystal polarity inversion signal M, which inverts the polarity of the STN liquid crystal, is generated (step 840).

If the STN LCD is driven by the conventional nFRC method, the liquid crystal polarity inversion signal generator 540 receives the sub frame flag signal SFFLAG and inverts the level of the liquid crystal polarity inversion signal M.

If the STN LCD is driven by a general N-line inversion method, the liquid crystal polarity inversion signal generator 540 receives the N-line flag signal NLFLAG and inverts the level of the liquid crystal polarity inversion signal M.

However, in the present invention, it is possible to select the N-line flag signal NLFLAG or the sub frame flag signal SFFLAG by using the selection signal MSEL and select the frame flag signal FFLAG which inverts the level of the liquid crystal polarity inversion signal M in each frame.

If the frame flag signal FFLAG is selected, the level of the liquid crystal polarity inversion signal M is inverted in each frame. The selection signal MSEL is an externally inputted command.

Data are received, and a segment voltage, which drives a column electrode of the STN LCD, is generated in response to the level of the liquid crystal polarity inversion signal M(step 850). Data DATA means data displayed on the liquid crystal. The column driver 550 receives data DATA and generates the segment voltage VSEG in response to the liquid crystal polarity inversion signal M.

Figures 1, 2:
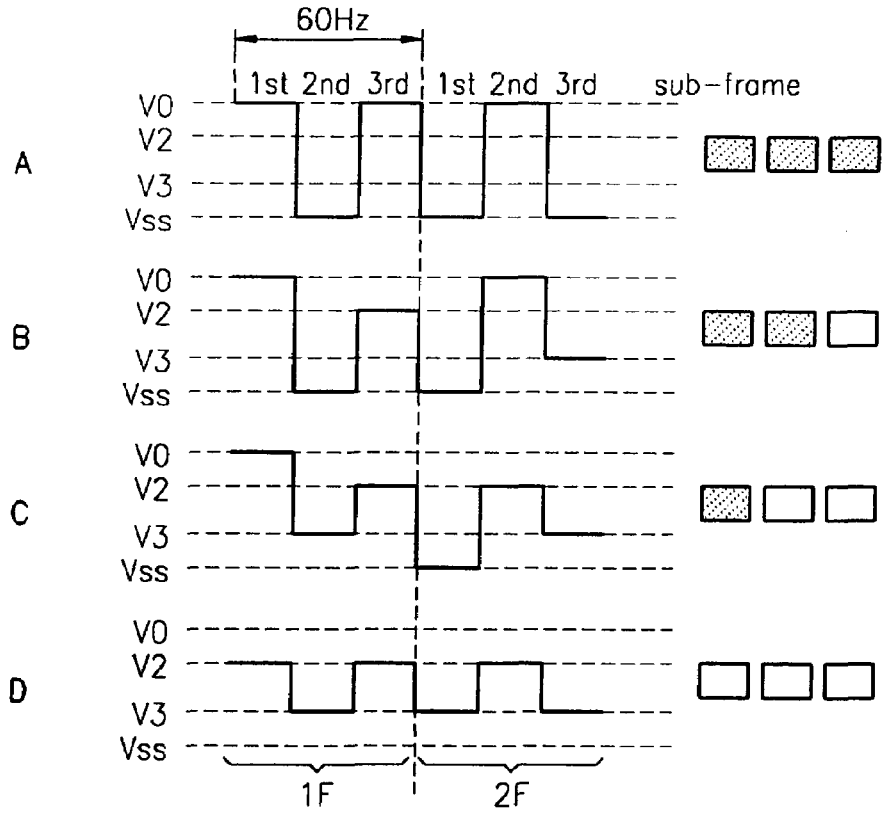
FIG. 1 (PRIOR ART)
FIG. 2 (PRIOR ART)
FIG. 1 is a table showing the levels of a super twisted nematic (STN) liquid crystal driving voltage in response to a level and selection or non-selection of a liquid crystal polarity inversion signal M used in a frame rate control (FRC) method.
Figure 3:
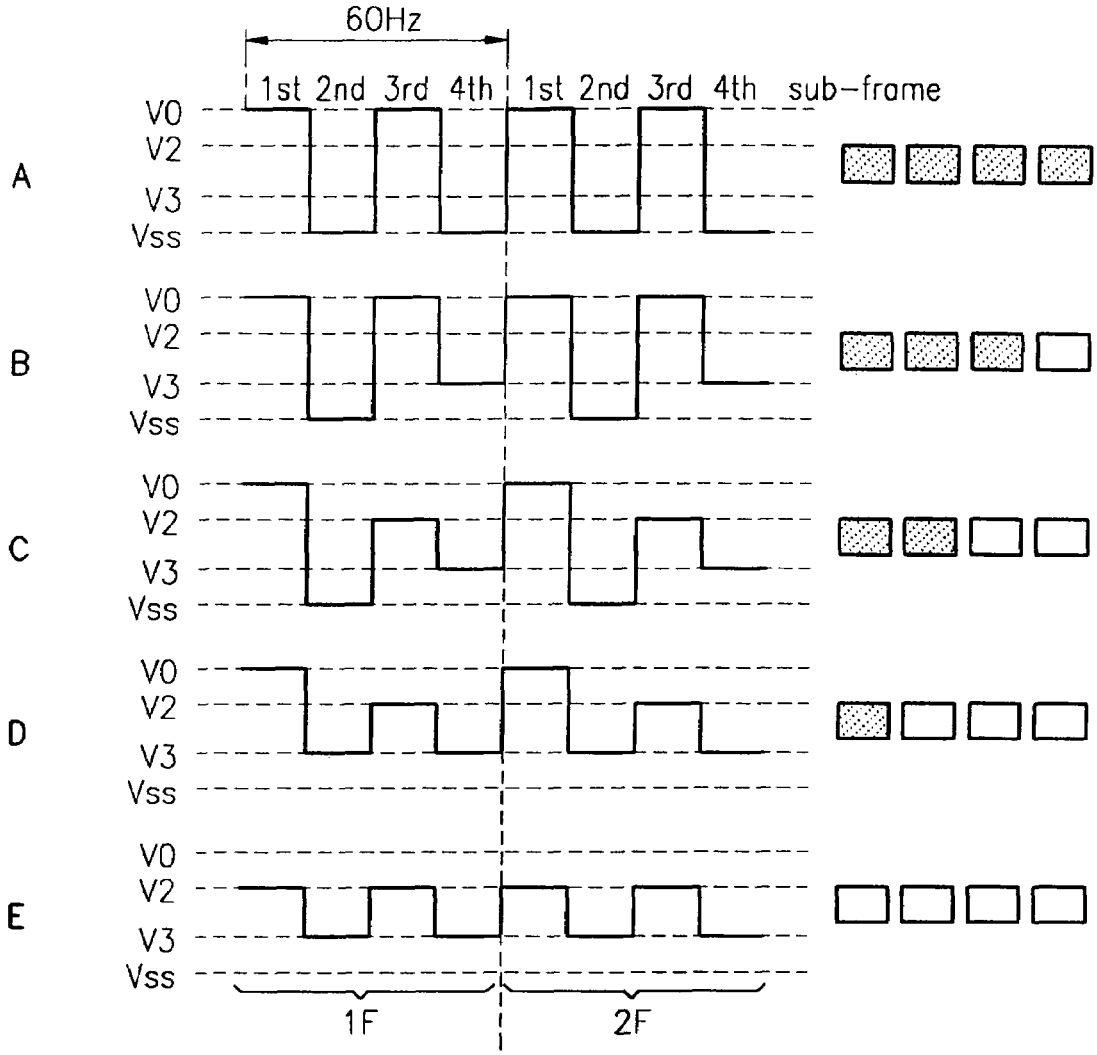
FIG. 3 (PRIOR ART)
FIGS. 3A through 3E are waveforms of a segment voltage VSEG used in a conventional STN LCD driving method using a 4FRC method.
Figure 4:
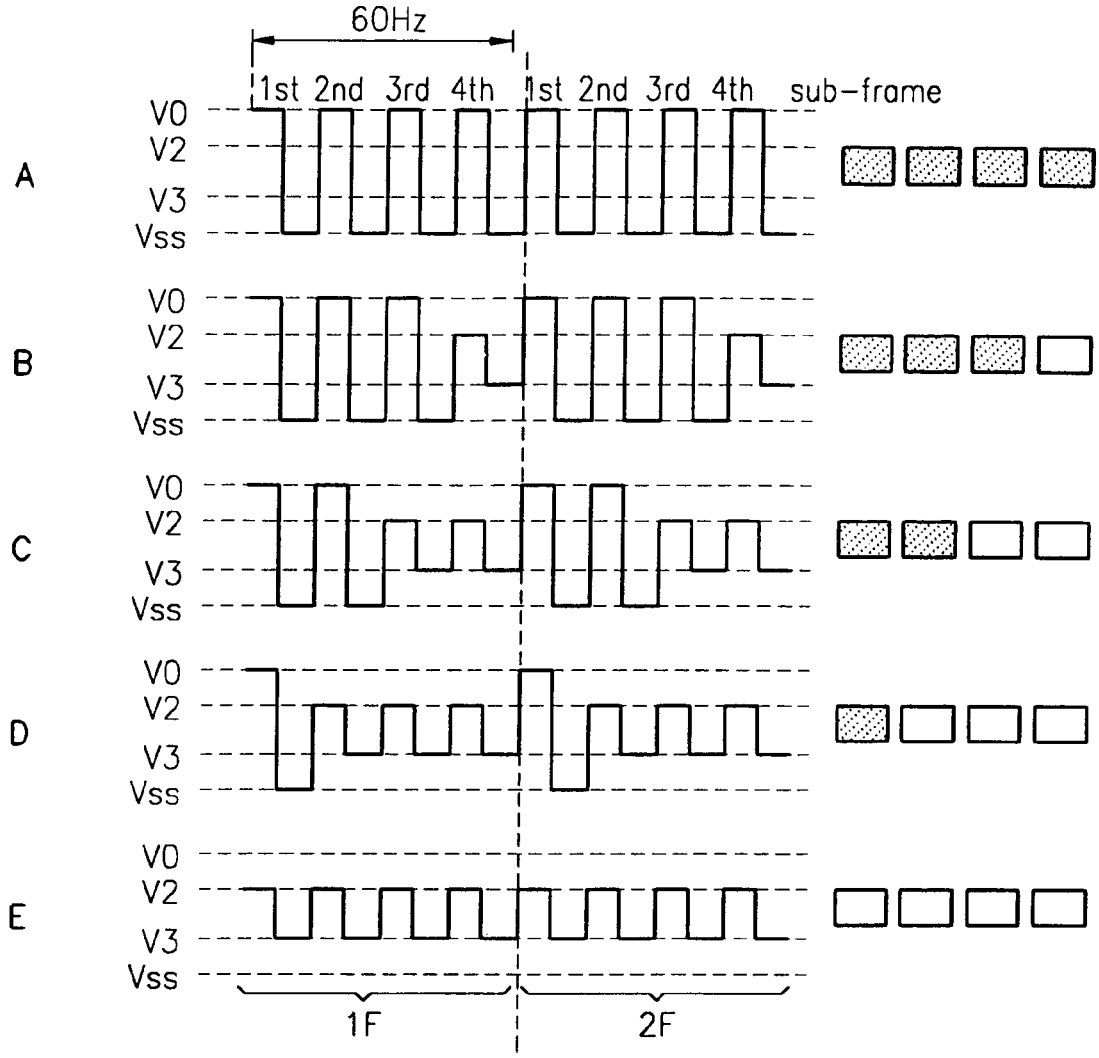
FIG. 4 (PRIOR ART)
FIGS. 4A through 4E are waveforms of a segment voltage used in an STN LCD driving method using an N-line inversion method.

The segment voltage VSEG is generated according to the table of FIG. 1. That is, in order to present the liquid crystal as dark, the level of the segment voltage VSEG has to be equal to the selection voltage level. Since the level of the liquid crystal polarity inversion signal M is inverted in each frame, the level of the segment voltage VSEG generated is V0 in one frame if the level of the liquid crystal polarity inversion signal M is high. Since the level of the liquid crystal polarity inversion signal M is low in the next frame, the level of the segment voltage VSEG generated is Vss.

A row selection signal is received, and a corn voltage, which drives a row electrode of the STN liquid crystal, is generated in response to the level of the liquid crystal polarity inversion signal M (step 860). The row selection signal RSEL is a signal for selecting a row electrode to transmit the com voltage to the row electrode of the liquid crystal.

The row driver 560 receives the row selection signal RSEL and generates the corn voltage VCOM in response to the level of the liquid crystal polarity inversion signal M. The corn voltage VCOM is generated according to the table of FIG. 1.

FIGS. 6A through 6D are waveforms of a segment voltage in the STN LCD driver of FIG. 5 using a 3FRC method.

Figure 6:
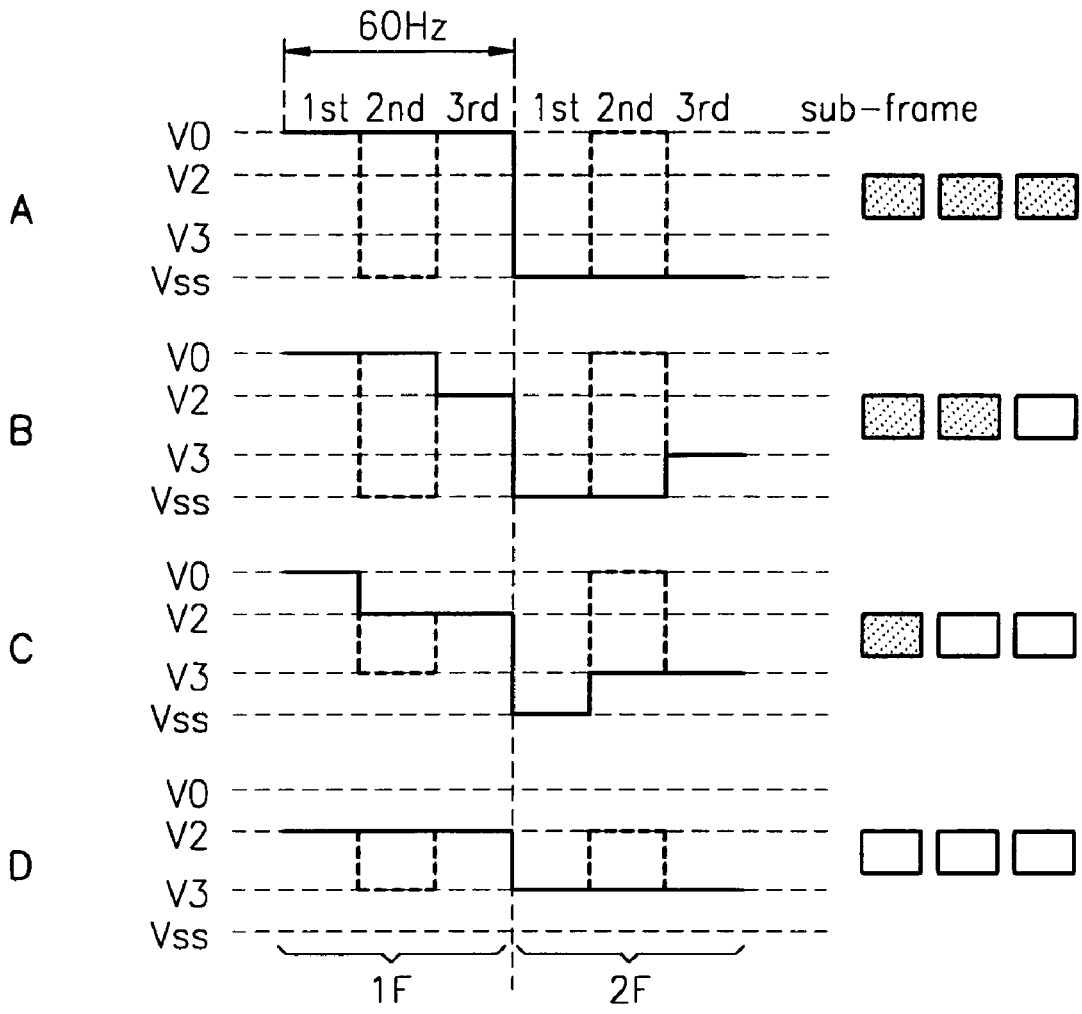
FIGS. 6A through 6D are waveforms of a segment voltage in the STN LCD driver of FIG. 5 using a 3FRC method.

In FIG. 6, a waveform of the segment voltage VSEG using the conventional 3FRC method is indicated by a dotted line, and a waveform of the segment voltage VSEG according to the present invention is indicated by a solid line. In the conventional 3FRC method, the level of the liquid crystal polarity inversion signal M is inverted in each sub frame. However, in the present invention, the level of the liquid crystal polarity inversion signal M is inverted in every three sub frames, i.e., each frame.

Referring to FIG. 6A where the liquid crystal is presented as black, the level of the segment voltage VSEG maintains V0 in a first frame 1F where the level of the liquid crystal polarity inversion signal M is high. The level of the segment voltage VSEG maintains Vss in a second frame 2F where the level of the liquid crystal polarity inversion signal M is low.

Thus, in comparison to the waveform of the segment voltage VSEG in the conventional art, transitions between the voltage levels V0 and Vss decreases by ⅓. Therefore, power consumption due to transitions of the levels of the segment voltage VSEG can be reduced.

Referring to FIG. 6B where the liquid crystal presents dark gray and FIG. 6C where the liquid crystal is presented as light gray, the non-selection voltage levels V2 and V3 are used the same number of times. Referring to FIG. 6D where the liquid crystal is presented as white, transitions between the non-selection voltage levels V2 and V3 decreases by ⅓ compared to the waveform of the segment voltage VSEG in the conventional art. Therefore, power consumption due to transitions between the levels of the segment voltage decreases.

FIGS. 7A through 7E are waveforms of a segment voltage in the STN LCD driver of FIG. 5 using a 4FRC method.

Figure 7:
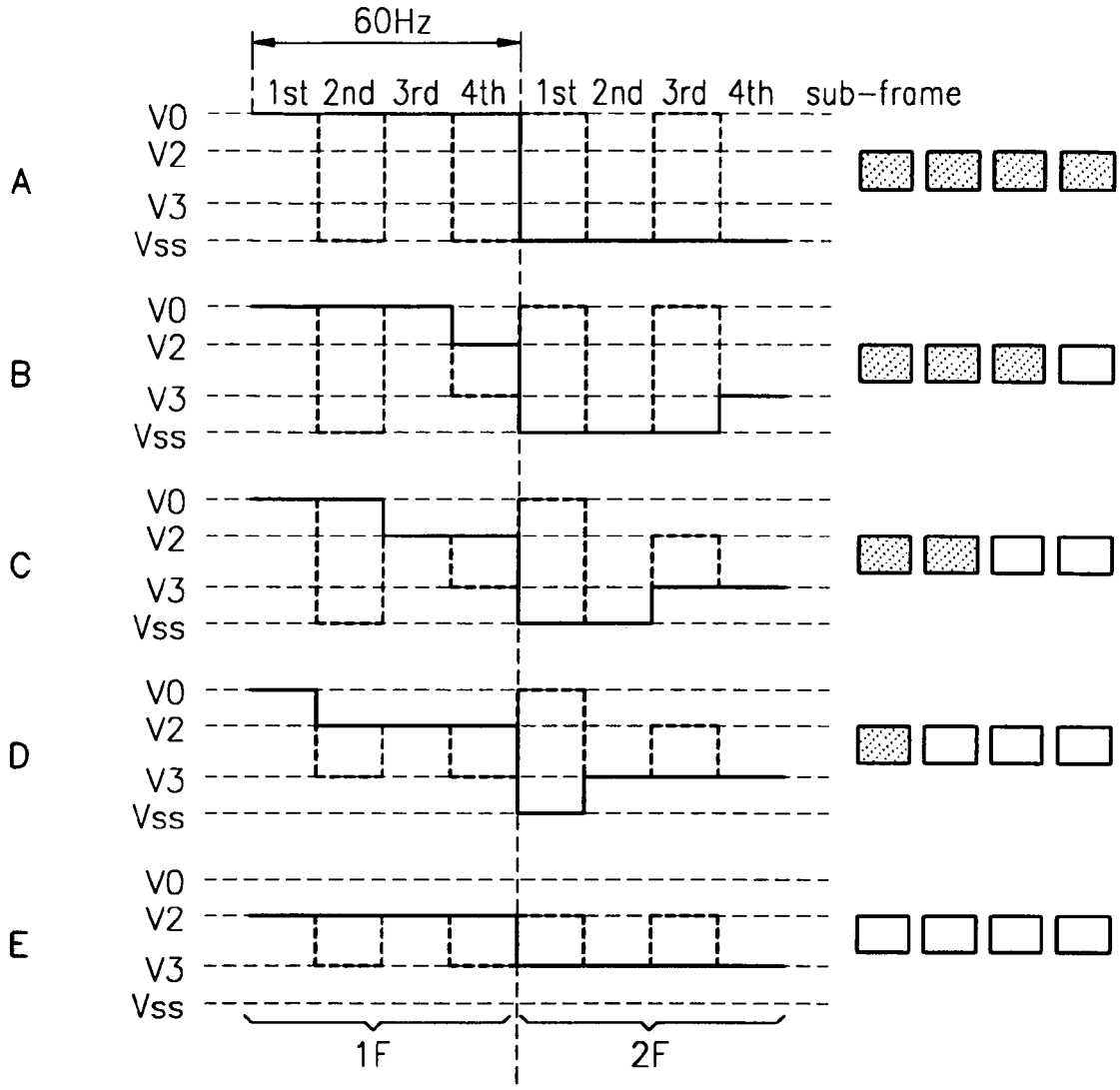
FIGS. 7A through 7E are waveforms of a segment voltage in the STN LCD driver of FIG. 5 using a 4FRC method.

In FIG. 7, a waveform of the segment voltage VSEG using the conventional 4FRC method is indicated by a dotted line, and a waveform of the segment voltage VSEG according to the present invention is indicated by a solid line. In the conventional 4FRC method, the level of the liquid crystal polarity inversion signal M is inverted in each sub frame. However, in the present invention, the level of the liquid crystal polarity inversion signal M is inverted in every four sub frames, i.e., each frame.

Referring to FIG. 7A where the liquid crystal is presented as black, the level of the segment voltage VSEG maintains V0 in a first frame 1F where the level of the liquid crystal polarity inversion signal M is high. The level of the segment voltage VSEG maintains Vss in a second frame 2F where the level of the liquid crystal polarity inversion signal M is low.

Thus, in comparison to the waveform of the segment voltage VSEG in the conventional art, transitions between the voltage levels V0 and Vss decrease by ¼. Therefore, power consumption due to transitions of the levels of the segment voltage VSEG can be reduced.

Referring to FIGS. 7B, 7C, and 7D, the non-selection voltage levels V2 and V3 are not used the same number of times. Referring to FIG. 7E where the liquid crystal is presented as white, transitions between the non-selection voltage levels V2 and V3 decrease by ¼ compared to the waveform of the segment voltage VSEG in the conventional art. Therefore, power consumption due to transitions between the levels of the segment voltage VSEG decreases.

In addition, since the selection voltage levels or the non-selection voltage levels are not the same number of times, cross talk does not occur in the liquid crystal.

Figure 10:
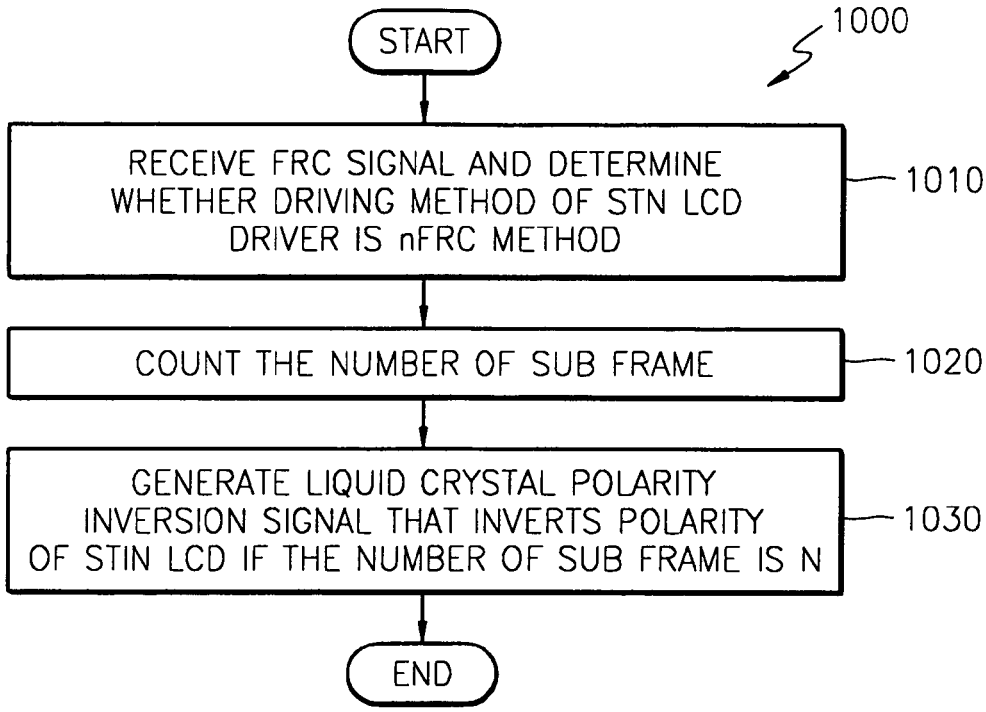
FIG. 10 is a block diagram showing a driving method of an STN LCD driver according to another embodiment of the present invention.

FIG. 10 is a block diagram showing a driving method of an STN LCD driver according to another embodiment of the present invention.

Figure 11:
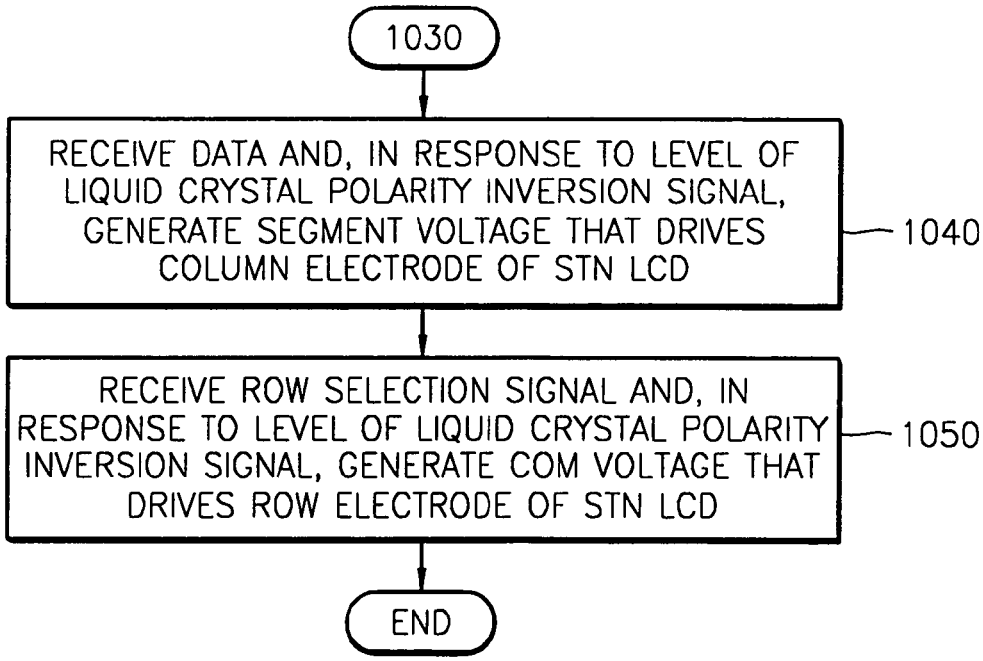
FIG. 11 is a block diagram showing a driving method of an STN LCD driver further included in the method of FIG. 10.

FIG. 11 is a block diagram showing a driving method of an STN LCD driver further included in the method of FIG. 10. Referring to FIGS. 10 and 11, in a driving method of an STN LCD driver 1000, a FRC signal is received, and it is determined whether a current driving method of an STN LCD driver is an nFRC method (step 1010).

The FRC signal has information on whether the driving method of the STN LCD driver is the nFRC method. In the nFRC method, one frame is comprised of n sub frames.

The number of sub frames is counted (step 1020). If the number of sub frames is n, the liquid crystal polarity inversion signal M, which inverts the polarity of the liquid crystal, is generated (step 1030).

In the nFRC method, the liquid crystal polarity inversion signal M is generated in each frame because one frame is comprised of n sub frames. If the liquid crystal polarity inversion signal M is generated, the polarity of the liquid crystal is inverted, and the liquid crystal is prevented from solidifying.

There may be various methods of generating the liquid crystal polarity inversion signal M in each frame. A method of generating the liquid crystal polarity inversion signal M by using a counter, which counts the number of sub frames and generates the liquid crystal polarity inversion signal M every time when the number of sub frames counted is n, belongs to such methods. Since one frame is comprised of n sub frames in the nFRC method, counting of n sub frames is the same as counting one frame.

Data are received, and a segment voltage that drives a column electrode of the STN LCD is generated in response to the level of the liquid crystal polarity inversion signal M (step 1040). A row selection signal is received, a corn voltage that drives a row electrode of the STN LCD is generated in response to the level of the liquid crystal polarity inversion signal M (step 1050). Steps 1040 and 1050 have been described in detail above. Therefore, their description will not be repeated.

As still another embodiment of the present invention, a driving method of an STN LCD driver using an nFRC method further includes inverting a polarity of the liquid crystal in each frame.

The STN LCD driver using the nFRC method inverts the polarity of the liquid crystal in each sub frame in order to prevent the liquid crystal from solidifying. However, in the present invention, the polarity of the liquid crystal is inverted in each frame, and the segment voltage level is transitioned in response to inversion of the polarity of the liquid crystal.

If the polarity of the liquid crystal is inverted in each frame, the selection voltage levels or the non-selection voltage levels of the segment voltage are used the same number of times. Thus, cross talk can be prevented from occurring, and power consumption can be reduced. The methods of generating the liquid crystal polarity inversion signal M in each frame are described above, therefore, description of such methods will not be repeated.

According to an STN LCD driver and a driving method of an STN LCD driver, the selection voltage levels or the non-selection voltage levels can be used the same number of times, and cross talk can be prevented from occurring in an LCD by reducing the number of transitions of segment voltage levels. In addition, power consumption can be reduced.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A super twisted nematic (STN) liquid crystal display (LCD) driver that drives an STN LCD comprising:

a sub frame counter, which counts a number of sub frames in a frame in response to a clock signal and generates a sub frame flag signal every time each sub frame is counted in the frame;

an N clock counter, which receives an N-line signal and generates an N-line flag signal every time the number of N-lines counted is N in response to the clock signal;

a frame counter, which receives a frame rate control (FRC) selection signal, counts the number of the sub frame flag signals received from the sub frame counter, and generates a frame flag signal every time the number of the sub frame flag signals counted is n; and a liquid crystal polarity inversion signal generator, which selects one of the sub frame flag signal and the N-line flag signal in response to a selection signal, and further selects the frame flag signal which inverts a level of a liquid crystal polarity inversion signal in the frame, and generates the liquid crystal polarity inversion signal that inverts a polarity of an STN liquid crystal of the STN LCD in the frame.

2. The STN LCD driver of claim 1, wherein the STN LCD driver further comprises:

a column driver, which receives data and generates a segment voltage that drives a column electrode of the STN LCD in response to a level of the liquid crystal polarity inversion signal; and a row driver, which receives a row selection signal and generates a com voltage that drives a row electrode of the STN LCD in response to the level of the liquid crystal polarity inversion signal.

3. The STN LCD driver of claim 1, wherein the FRC selection signal has information on whether a driving method of the STN LCD is an nFRC method, where n is a natural number.

4. The STN LCD driver of claim 1, wherein the N-line signal has information used to divide a frame into N sub frames, where N is a natural number.

5. A driving method of a super twisted nematic (STN) liquid crystal display (LCD) driver that drives an STN LCD, the driving method comprising:

(a) counting the number of sub frames in a frame in response to a clock signal and generating a sub frame flag signal every time each sub frame is counted in the frame;

(b) receiving an N-line signal and generating an N-line flag signal in response to input of the clock signal every time the number of N-line counted is N in response to the clock signal;

(c) receiving a frame rate control (FRC) selection signal, counting the number of sub frame flag signals received from the sub frame counter, and generating a frame flag signal every time the number of sub frame flag signals counted is n; and (d) selecting one of the sub frame flag signal and the N-line flag signal in response to a selection signal, and further selecting the frame flag signal which inverts a level of a liquid crystal polarity inversion signal in the frame, and generating the liquid crystal polarity inversion signal that inverts a polarity of an STN liquid crystal of the STN LCD in the frame.

6. The driving method of claim 5, wherein the driving method of the STN LCD driver further comprises:

(e) receiving data and generating a segment voltage that drives a column electrode of the STN LCD in response to the level of the liquid crystal polarity inversion signal; and (f) receiving a row selection signal and, in response to the level of the liquid crystal polarity inversion signal, generating a com voltage that drives a row electrode of STN LCD.

7. The driving method of claim 5, wherein the FRC selection signal has information on whether a driving method of the STN LCD is an nFRC method, and the n is a natural number.

8. The driving method of claim 5, wherein the N-line signal has information used to divide a frame into N sub frames, and the N is a natural number.

9. A driving method of a super twisted nematic (STN) liquid crystal display (LCD) driver using an nFRC method that drives an STN LCD, wherein n is a natural number, the driving method comprising:

(a) determining whether a frame rate control (FRC) selection signal is in accordance with an nFRC method;

(b) counting a number of sub frames in a frame and generating a frame flag signal in response to the FRC selection in accordance with the nFRC method; and (c) receiving the frame flag signal which inverts a level of a liquid crystal polarity inversion signal in the frame, wherein the liquid crystal polarity inversion signal inverts a polarity of an STN liquid crystal of the STN LCD only once in the frame when the number of sub frames in the frame, counted in step (b), is n.

10. The driving method of claim 9, wherein the driving method of the STN LCD driver further comprises:

(d) receiving data and, in response to the level of the liquid crystal polarity inversion signal, generating a segment voltage that drives a column electrode of the STN LCD; and (f) receiving a row selection signal and, in response to the level of the liquid crystal polarity inversion signal, generating a com voltage that drives a row electrode of the STN LCD.

11. The driving method of claim 9, wherein n sub frames constitute one frame.

12. A driving method of a supertwisted nematic (STN) liquid crystal display (LCD) driver using an nFRC method, wherein n is a natural number, comprising:

(a) counting a number of sub frames in a frame; and generating a frame flag signal in response to the FRC selection signal in accordance with the nFRC method;

(b) inverting a polarity of an STN liquid crystal is inverted only once in each frame_when the number of sub frames in the frame, counted in step (a), is n.

13. The driving method of claim 9, wherein one frame is comprised of n sub frames.

* * * * *

UNITED STATES PATENT AND TRADEMARK OFFICE

CERTIFICATE OF CORRECTION

PATENT NO. : 7,391,395 B2
APPLICATION NO. : 10/712164
DATED : June 24, 2008
INVENTOR(S) : Kim It is certified that error appears in the above-identified patent and that said Letters Patent is hereby corrected as shown below:

Column 10, line 55, delete “;” after “frame”

Column 10, line 57, insert -- and -- after “nFRC method;”

Column 10, line 58, delete “is inverted” after “crystal”

Column 10, line 59, delete “_” and insert a space between “frame” and “when”

Signed and Sealed this

Sixteenth Day of December, 2008

JON W. DUDAS
*Director of the United States Patent and Trademark Office*